United States Patent [19]

Anderson

[11] 4,109,380

[45] Aug. 29, 1978

[54] CUTTING TOOL AND BLADE HOLDER FOR REPLACEABLE BLADES

[76] Inventor: Lloyd E. Anderson, 6408 74th Ave. N., Brooklyn Park, Minn. 55428

[21] Appl. No.: 871,352

[22] Filed: Jan. 23, 1978

Related U.S. Application Data

[63] Continuation-in-part of Ser. No. 812,587, Jul. 5, 1977, abandoned.

[51] Int. Cl.[2] ..... B26B 5/00

[52] U.S. Cl. ..... 30/162; 30/335; 30/125

[58] Field of Search ..... 30/162, 293, 294, 329, 30/335, 125, 317

[56] References Cited

U.S. PATENT DOCUMENTS

| | | | |
|---|---|---|---|
| 510,775 | 12/1893 | Christy | 30/162 |
| 2,285,155 | 6/1942 | Frost | 30/162 |
| 2,374,502 | 4/1945 | Rose | 30/162 |
| 2,464,408 | 3/1949 | Lightburn | 30/162 |
| 2,599,407 | 6/1952 | Miller | 30/335 |
| 2,736,960 | 3/1956 | Armstrong | 30/162 |
| 3,621,570 | 11/1971 | Kolde et al. | 30/162 |
| 3,943,627 | 3/1976 | Stanley | 30/125 |

FOREIGN PATENT DOCUMENTS

| | | | |
|---|---|---|---|
| 12,061 | 4/1880 | Fed. Rep. of Germany | 30/335 |

*Primary Examiner*—Jimmy C. Peters

*Attorney, Agent, or Firm*—Schroeder, Siegfried, Ryan, Vidas, & Steffey

[57] ABSTRACT

A cutting tool designed for changing or repositioning blades without requiring internal access to the tool, as by opening or otherwise taking the handle apart for access to the blade. The tool in one preferred form has only the end opening, out of which the blade extends for cutting, for gaining access to the blade to reposition or change it.

A blade holder for holding a cutting blade rigidly in place while cutting but allowing the blade to be readily repositioned in or removed from the holder for replacement or positional adjustment therein. The holder is configured such that it adjustably and slidably holds the cutting blade in a selected position by lateral surface area contact or wedging of the blade in the holder in a cutting position.

29 Claims, 16 Drawing Figures

CUTTING TOOL AND BLADE HOLDER FOR REPLACEABLE BLADES

BACKGROUND AND BRIEF DESCRIPTION OF THE INVENTION

This application is a continuation-in-part of parent application Ser. No. 812,587, filed July 5, 1977, now abandoned, for Cutting Tool.

This invention is directed to cutting tools or knives which use replaceable cutting blades. Such tools are, generally speaking, merely blade holders with handles. They are available in a wide variety of shapes and configurations and are useful for cutting various materials including fabrics such as rugs and carpeting. They are also used for cutting materials such as tile and linoleum, vinyl fabric, upholstery, wall board, paneling, and other materials. They are particularly useful where it is important that the cutting blade be changed frequently to assure a sharp and proper cutting edge. One of the shortcomings of currently available knives with replaceable blades is that the changing of the cutting blade is cumbersome and time-consuming. In typical prior art cutting tools, in order to change the blade, the tool assembly is taken apart so that the old blade can be removed, a new one put into the required position, and the assembly put back together. With present labor costs, this is an expensive procedure. It is also a bothersome task for the worker. As a result, the blade is not changed as often as it should be and the edges of the material being cut are finished off improperly.

Another difficulty with many prior art tools is that they require the replaceable blade to be slotted or otherwise apertured to allow for fixedly positioning the blade in the tool while cutting. Apertures in the blade cause weakened areas where breaking occurs if excessive pressure is used on the blade when cutting. Blade breakage results in wasted time while the worker changes blades.

Many prior art tools have a storage compartment for extra blades which is provided when the two halves of the handle are secured together. This arrangement requires that, in order to gain access to extra blades stored between the tool halves, the worker must disassemble them, again wasting time.

The present invention provides a simple blade holder which may be made integral with or secured to any available cutting tool handle. The blade holder includes means for adjustably and slidably receiving the cutting blade. The fit between the blade and certain areas of the holder is such that the blade is fixedly held in a cutting position as its cutting edge engages the material to be cut but is readily released from the cutting position and/or may be readily removed from the holder after the blade edge is disengaged from the material being cut. Changing a blade takes no more than a few seconds to accomplish and the tool need not be disassembled to do this.

Another advantage of the present invention is that the blade used therewith need not be apertured, although apertured blades will function in this blade holder. Thus, use of the present invention also reduces the problems created by blade breakage because of weakened areas on the blade due to such apertures.

In order to provide easy access to extra blades, the handle of a tool used with the present invention may be provided with a cavity or hollow portion in which extra blades are stored and a slide or other convenient closure member may be used to cover the cavity or hollow portion for easy access. The worker then need only move or remove the slide or closure to quickly reach a new blade without having to disassemble the entire handle as is the case with prior art tools.

SUMMARY OF THE INVENTION

In general, the invention is directed to a tool which need not be disassembled to change or reposition blades. That is, a tool in a most preferred form is disclosed in which access to the blade need only be provided by the end opening out of which the blade extends when in the cutting position. From essentially this opening alone, the blade can be changed or repositioned by grasping the blade and moving it as desired.

In the most preferred form of the invention, the blade holder, which is preferably internally mounted but may be external as well, comprises two interfitting parts which form a guideway having specially configured inner surfaces for slidably receiving a blade therebetween. The surfaces are spaced about a blade's width apart, except in the area of the cutting edge or edges, where the surfaces are closer together. If part of the blade other than a cutting edge is wedged into a closer spaced area, the blade is fixedly positioned for cutting.

Preferably, the guideway will include an area for slidably receiving the blade and a second area below the first area for receiving the cutting edge of a single edged blade or, in the case of a double edged blade, an upper and a lower area for receiving the cutting edges of the blade.

The various receiving areas described can be provided by adjacent contoured inner surfaces of the blade holder or by upper and lower blade holding channel members having what is described herein as a generally V-shaped cross section.

Blade holders, according to this invention, may take various configurations. The preferred forms are described below.

DETAILED DESCRIPTION OF PREFERRED EMBODIMENTS

Figure 1:
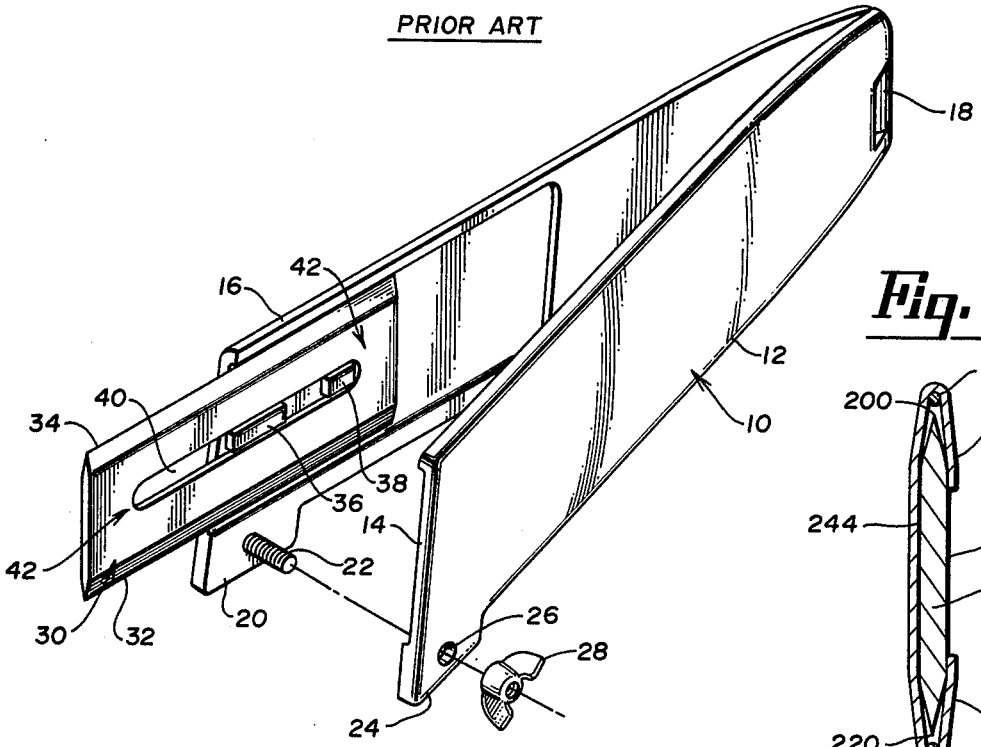
Fig. 1 PRIOR ART
FIG. 1 is a perspective view of a typical prior art cutting tool.

Referring first to FIG. 1, there is shown a typical prior art holder or cutting tool 10 having a handle 12 made up of two halves 14 and 16 which are hinged together by hinge 18. Tool 10 is shown with halves 14 and 16 of handle 12 in an open position. Handle half 16 has a lower lip 20 which has a threaded bolt 22 permanently affixed thereto projecting in the direction toward handle half 14. Handle half 14 has a similar lower lip 24 to lip 20 of half 16. Lip 24 has a hole 26 therein through which bolt 22 passes when handle halves 14 and 16 are brought together. Halves 14 and 16 may then be secured together by a wing nut 28 being threaded onto bolt 22.

In order to be able to rigidly hold a cutting blade such as double edged blade 30 having parallel upper and lower cutting edges 32 and 34, handle half 16 is provided on the inner wall thereof with spaced apart ridges 36 and 38. Blade 30 has an elongated slot 40 therein which is placed over ridges 36 and/or 38 depending on the amount of cutting edges 32 and 34 it is desired to expose. Ridges 36 and 38, when located in slot 40 and with handle halves 14 and 16 fastened together, serve to rigidly hold blade 30 in place, such as in an extended cutting position as shown.

There are several deficiencies inherent in this type of prior art cutting tool. First, it requires a time-consuming effort every time a blade is to be changed. To do so, wing nut 28 must be unfastened, halves 14 and 16 must be separated, the old blade removed, a new blade inserted in the required position so as to expose the desired amount of cutting edge, halves 14 and 16 closed, and wing nut 28 refastened to bolt 22 to secure the blade and handle in place. In addition, because of slot 40 in blade 30, weakened areas shown by arrows 42 are created around slot 40 so that, if excessive pressure is applied when cutting, blade 30 is more readily susceptible to breakage in these weakened areas.

Figure 2:
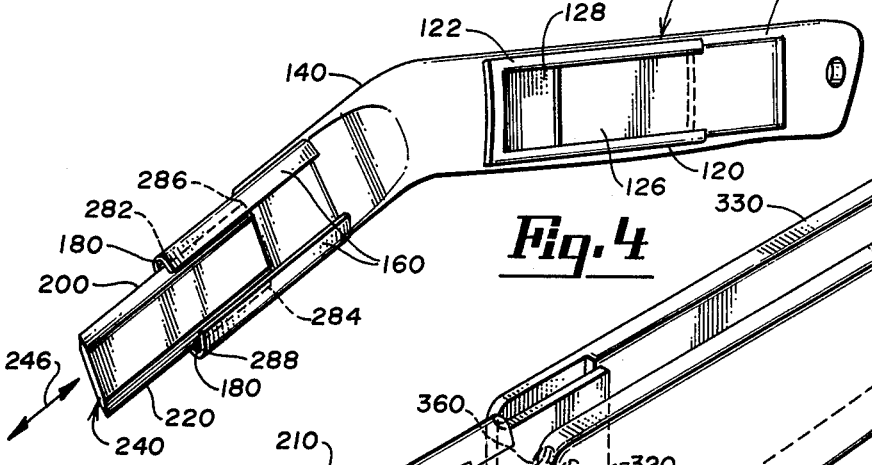
FIG. 2 is a perspective view of one embodiment of the invention where the blade holder and tool handle are formed as an integral assembly.
Figure 6:
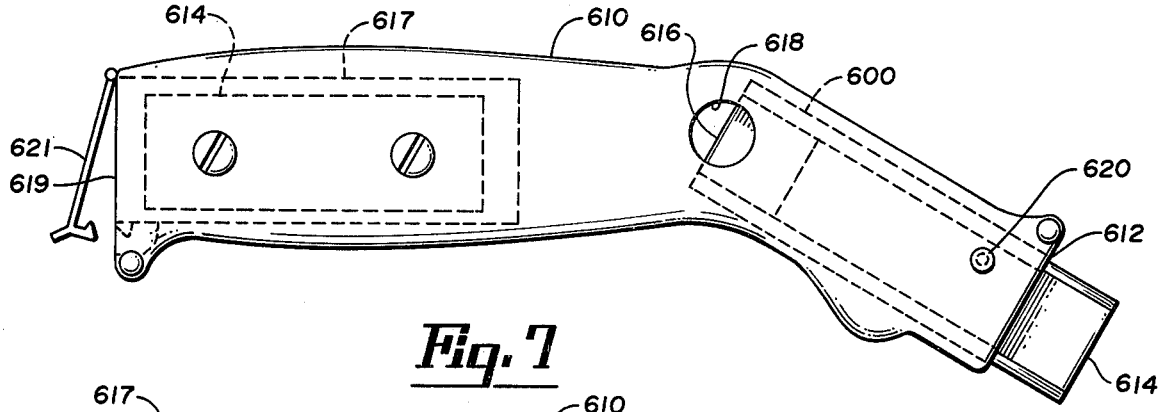
FIG. 6 is a view of yet another embodiment of a cutting tool according to the invention, the handle of which consists of two separate halves secured together by screws and/or rivets.

FIG. 2 shows a perspective view of a cutting tool 100 according to the present invention formed as one integral assembly. Tool 100 has a handle portion 120 which can be gripped when using the tool for cutting. Handle portion 120 may optionally be provided with an easily accessible compartment 122 for storage of extra blades. Compartment 122 may simply be a cavity or hollowed-out portion in the wall 124 of handle 120. A cover may be provided for compartment 122 by a simple slide 126, or other suitable closure means, shown in FIG. 2 in partially open position, whereby a stored blade 128 is visible. When a new blade is desired, slide 126 is moved to its fully open position, new blade 128 is removed, and the slide 126 moved to its closed position. As shown in FIG. 6, a hinged end cap with a suitable catch or lock may also be used.

Figure 3:
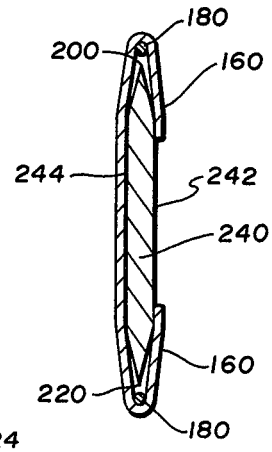
FIG. 3 is an enlarged end view of the blade holder of the invention shown in FIG. 2.

At one end of tool 100 is a curved or goose-neck portion 140 along which at one end a guideway is formed for a blade comprising two opposing parallel, spaced-apart, channel sections which form generally V-shaped or U-shaped stabilizing members 160. Each member 160 defines an elongated groove, and the grooves together form a guideway into which a blade 240, having opposite sides 242 and 244, may be adjustably and slidably received. Although stabilizing members 160 are V-shaped or U-shaped in cross section, as best seen in FIG. 3, other configurations may be used so long as the grooves or channels include first areas of a width comparable to the thickness of the blade body proper as shown at 160 in FIG. 3 and a narrower area or areas for receiving the cutting edge or edges of the blade as shown at 200 and 220 in FIG. 3. In such an arrangement, sides 242 and 244 of blade 240 are slidably received and the blade can be moved in the guideway defined by the wider areas of the grooves as can be seen in FIG. 3. Stabilizing members 160 may be formed integrally on portion 140, as shown, by bending the ends to form these generally V-shaped sections. Although integrally formed on portion 140, stabilizing members 160 may also comprise separate pieces which are attached by various means, such as screws, to goose-neck portion 140.

Although blade 240 is of the rectangular-shaped type, any standard type blade may be employed with this invention, including blades with only one cutting edge and with or without an aperture.

The dimensions of the guideway defined between the two grooves provided by members 160 is such that blade 240 can be easily adjustably and slidably inserted within the slot and yet easily removed as shown by the double-headed arrow 246 in FIG. 2. Disassembly of the tool is not required to remove the blade therefrom. The grooves defined by V-shaped members 160 are spaced slightly farther apart than the cutting edges on top and bottom of blade 240 and of just sufficient width to allow blade 240 to be easily slid within the grooves to any position along the length of members 160. As shown in the enlarged view of FIG. 3, opposite sides 242 and 244 of blade 240 are confined by V-shaped members 160. When slid into the slot defined by members 160, cutting edges 200 and 220 do not come in contact with the bottoms of the grooves but opposing sides 242 and 244 are held in place relatively firmly by V-shaped members 160. In this non-cutting position, blade 240 is preferably held sufficiently firmly that it cannot fall out of the slot defined by members 160, even if the tool is held vertically with the blade directed downward. However, a loose fit is also acceptable and in such a case a set screw or internal spring members may be used to hold the blade in the guideway by pressing against the side of the blade. A set screw is also described below in connection with the most preferred embodiment. When cutting edge 220 engages an object to be cut, such as carpeting material illustrated by 270 in FIG. 4, blade 240 is titled slightly in the guideway and portions of it wedge in the grooves and it is rigidly held in place. When cutting edge 220 is disengaged from material 270, blade 240 may easily and quickly be straightened within members 160 by tapping the upper corner of the blade whereby it is loosened and it may be slid out of the guideway defined by members 160 for replacement or otherwise repositioned therein. It should be also noted that if cutting edge 200 has not been used, since it is still sharp, the handle need merely be flipped over and the cutting edge 200 engaged with the material to be cut, thereby locking blade 240 in place to be held firmly in position at points 286 and 288 shown in FIG. 2. Such use would be facilitated in an arrangement where the attachment is like the embodiments in FIGS. 2 and 5; that is, the stabilizing or V-shaped members are of equal length and the gripping handle is a straight member as the handle 200 in FIGS. 4 and 5 rather than a goose-necked handle 120 as in FIG. 2.

The position of blade 240 along the length defined by the guideway will be dependent upon the depth or thickness of the object to be cut and the length of cutting edge 220 of the blade it is desired to expose. Blade 240 thus may be adjustably located in an infinite number of positions along the slot defined by members 160 and will be held in rigid position when edge 220 engages an object to be cut and the desired length of cutting edge 220 of the blade exposed.

The entire tool 100 shown in FIG. 2 may be made of any durable material. It may be integrally formed of a metal, plastic, hard rubber, or similar materials, metal being preferred. For example, the tool 100 as well as the other embodiments of the invention may be cast as a single piece out of a suitable metal, plastic, rubber, or similar material having the desired hardness, strength, durability, and other desirable characteristics.

Fillets 180 may be located in the grooves formed by members 160. Fillets 180 run the entire length of members 160 and may be provided to ensure that the cutting edges 200 and 220 of standard double edged cutting blade 240 are firmly held in a cutting position without damaging the cutting edges 200 and 220 while the tool is being used for cutting. Fillets 180 are of a soft metal or plastic. The fillets provide a surface for the cutting edges 200 and 220 so they are both protected against dulling. Alternatively and preferably, the fillets may be omitted if the separation of the grooves is such relative to the height of the blade proper that they hold the blade tightly enough to prevent its cutting edges "bottoming out" in the grooves when the blade is tilted into the locked position for cutting.

Fillets 180 may be a resilient material which allows a frictional grip between the grooves defined by each member 160 and the respective edge of the blade 240 with which it comes in contact. For example, fillets 180 may be made of a soft babbit metal or a tin-lead solder that could be made to readily flow into the grooves of members 160. Also suitable is a metal material for members 160 which has an integral finish or coating which provides the necessary characteristics in the grooves defined by members 160 so that blade edges 200 and 220 are not damaged or lose their sharpness when portions of the edges bear against fillets 180 while the blade is cutting. On the other hand, if the attachment of the present invention were made of a suitable soft metal, plastic, or hard rubber material, fillets 180 as well as the fillets in the other embodiments may be eliminated without any damage being caused to the cutting edges if the blade should contact the bottom of the grooves. Also, as pointed out hereinabove, the fillets may be eliminated by properly sizing the grooves in members 160 relative to the thickness of the blade body so as to allow the blade edges to fit into the grooves but to tightly grip the sides of the blade body proper. In such an arrangement, the blade, upon being locked in the grooves, will be held tightly for cutting without the edges actually making any substantial contact with the bottoms of the grooves.

Figure 4:
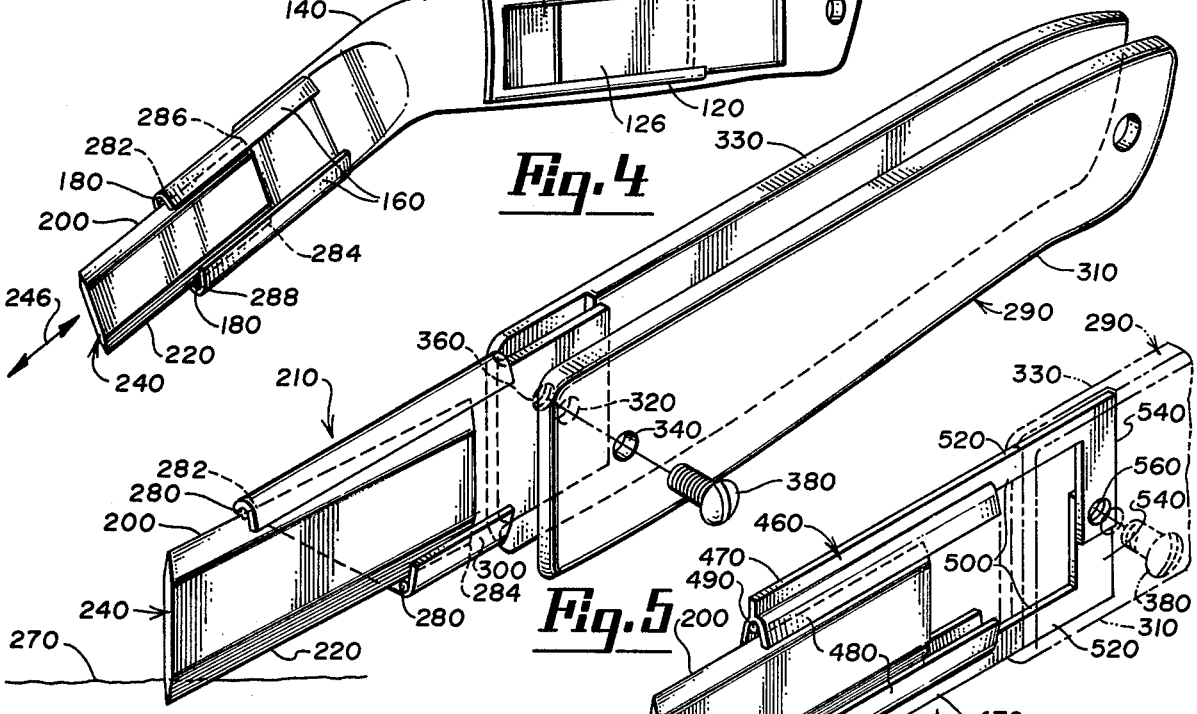
FIG. 4 is a perspective view of another embodiment of the invention where the blade holder is secured to a more or less standard cutting tool handle.

FIG. 4 shows an alternate version of the present invention in which blade holder 210 does not have an integral handle portion as in FIG. 2, but instead may be readily attached to a standard type of cutting tool handle 290. In this embodiment, blade holder 200 has a flat portion 300 which may be placed between the two halves 310 and 330 of the handle 290. Flat portion 300 has a hole 320 therein which may be aligned with the matching holes 340 and 360 in the two halves 310 and 330, respectively, of handle 290 so that screw 380 may pass respectively through holes 340, 320, and 360 into locking engagement. The two halves 310 and 330 when so screwed together allow flat portion 300 of holder 200 to be rigidly screwed to handle 290. Holder 200 has V-shaped stabilizing members 260 which are identical to members 160 in the embodiment of FIG. 2 except that, in this embodiment, the lower member 260 which confines edge 220 is somewhat shorter in length than upper member 260 which confines edge 200. This arrangement merely allows the lower cutting edge 220, the one in FIG. 4 which cuts material 270, to extend out slightly further than edge 200 to make the cutting easier. Once edge 220 becomes dulled, of course, blade 240 may be quickly and easily removed as described above and reversed with edge 200 now in the cutting position, if it is still sharp, or a new blade may be inserted. Fillets 280 may be included as in FIG. 2. The fit of blade 240 and the slot defined by members 260 is exactly the same as in the embodiment in FIG. 2, the only difference being that, in FIG. 2, holder 100 is integrally formed with a handle portion 120 while the embodiment in FIG. 4 is readily attachable to any standard cutting tool handle such as shown by handle 290.

Figure 5:
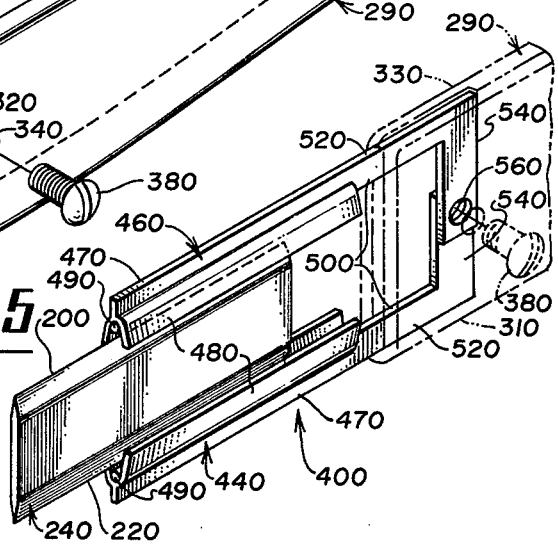
FIG. 5 is a perspective view of still another embodiment of the invention where the blade holder consists of two separate pieces which can be held together by a standard cutting tool handle.

The cutting tool blade holder of the present invention need not be a single member as in the embodiments in FIGS. 2 and 4. Another embodiment of the present invention is shown in FIG. 5 where holder 400 is used again in conjunction with standard cutting tool handle 290. Holder 400 is comprised of two identical halves 440 and 460. Each half 440 and 460 has a V-shaped stabilizing portion 480 which is the same as and serves the same function as members 160 and 260 in FIGS. 2 and 4 respectively. V-shaped portions 480 may have fillets 490 in the grooves defined by portions 480. These fillets 490 may be the same fillets 180 and 280 as shown in FIGS. 2 and 4. Integral with portions 480 are securing arms 500, each of which has a straight portion 520 which is contiguous with V-shaped portions 480 and an elbow portion 540 which is formed orthogonally with straight portion 520. Elbow portions 540, when in proper position, overlap one another and have holes 560 therein which when aligned allow screw 380 of handle 290 to pass therebetween for allowing the two halves 440 and 460 to be secured to handle 290. The relationship between blade 240 and V-shaped members 480 is exactly the same as in the other embodiments. However, in this embodiment, it may be necessary to provide V-shaped members 440 and 460 with greater strength since they are unconnected and not formed from a single unit as in the other embodiments. To provide this added strength, members 440 and 460 may be provided with fin portions 470. Fin portions 470 give members 440 and 460 additional strength when the tool and blade bear against the material to be cut.

Figure 7:
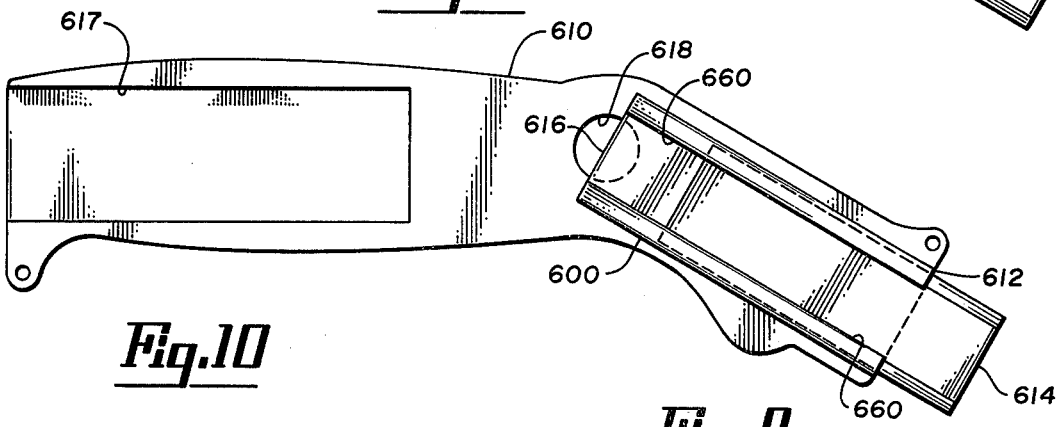
FIG. 7 is a view of the handle interior of the embodiment of FIG. 6 with one handle half removed.
Figure 8:
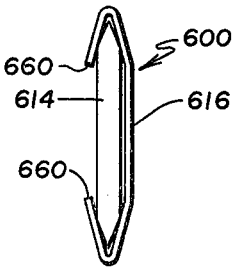
FIG. 8 is an enlarged end view of the blade holder shown in FIGS. 6 and 7.
Figure 9:
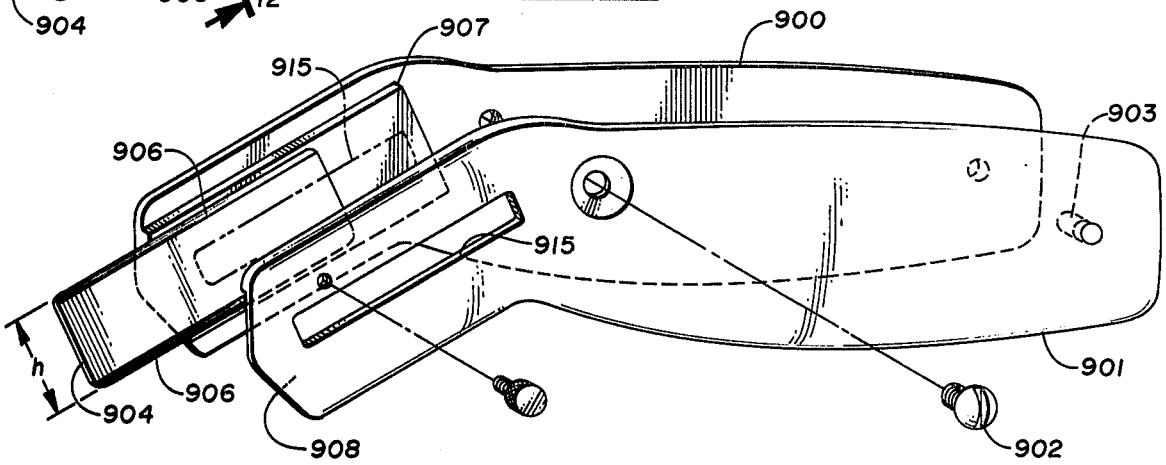
FIG. 9 is an exploded perspective view of the most preferred form of the invention making use of variously spaced interior surface areas of the holder parts to hold the blade in a sliding position (shown) and in a wedged cutting position (shown in FIG. 10)

Another embodiment of the invention is shown in FIGS. 6–8 in which the blade holder 600 is carried completely inside handle 610. When a blade is to be replaced, it is pulled out and a new blade is slipped into holder 600 through the end 612 of the tool. As with other embodiments, this tool may include compartment 617 for blade storage. It may be a cavity with an opening 619 at the rear end of the tool and having a hinged access door or end cap 621. FIG. 6 shows the tool as it is ready for use with a blade 614 partially extending therefrom for cutting. FIG. 7 shows the tool with one longitudinal half of the handle and the hinged end cap removed for better viewing of the blade holder 600.

Blade holder 600 includes the upper and lower channel members 660 which may be formed by bending over the opposite edges of a metal plate 616. Plate 616 may then be fastened to the inside of the tool handle by flush-set screws (not shown) or any other suitable means.

As shown in FIG. 8, the channel members 660 are formed to receive the cutting edges of the blade but to tightly bear against the lateral sides of the body proper of the blade so that only slight force is used to cause the blade to slide in the channel members. When pressing the blade against a surface to be cut, the blade tilts slightly within holder 600 so as to bring more lateral surface area of the body proper into deeper contact with the channel members and to lock the blade tightly for cutting. However, as already pointed out hereinabove, without fillets in the channels, care should be taken in most cases to size the channel member relative to the blade to prevent any substantial "bottoming out" of a cutting edge.

Aperture 618 is included to allow blade 614 to be pushed out of the handle by inserting an object such as a screwdriver on a nail into aperture 618 when blade 614 has been pushed all the way into the handle. The aperture is positioned at a large enough distance from the end 612 of the handle that the inner end of blade holder 600 and a fully inserted blade will reach approximately to the center of the aperture. Thus, it is possible to insert a tool or object into aperture 618 and push the end of the blade out of end 612 so that a portion of the blade can be grasped to pull it out to the desired length. Various aperture configurations are acceptable for this purpose.

A set screw 620 is included in handle 610 as a backup for situations where the blade may be somewhat loose in the channel members. In such instances, the set screw can be used to bear against the blade to prevent its dropping from the holder or sliding back into the handle. In such instances, once the blade has been brought to bear against a surface to be cut and caused to tilt between the channel members, it will lock into position as described above for the other embodiments. However, in cases of a somewhat loose fit, when the blade is not locked in a cutting position, the set screw will be used to prevent inadvertent dropping of the blade from the holder and handle and to prevent otherwise undesired movement of the blade.

Figure 10:
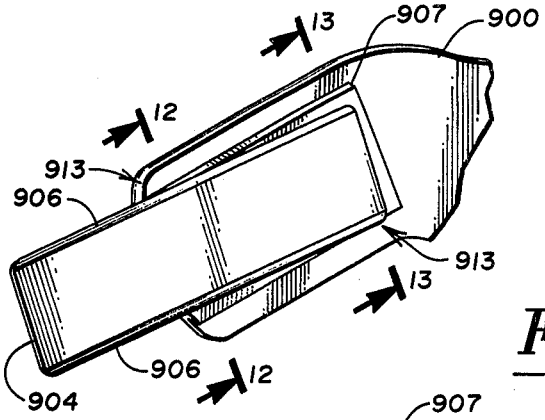
FIG. 10 is a partial pictorial view of the knife of FIG. 9 with parts removed, holder part having a raised interior surface area on which a blade is resting in a cocked cutting position, which in an assembled holder would cause the blade to be wedged and fixedly positioned for cutting.
Figure 11:
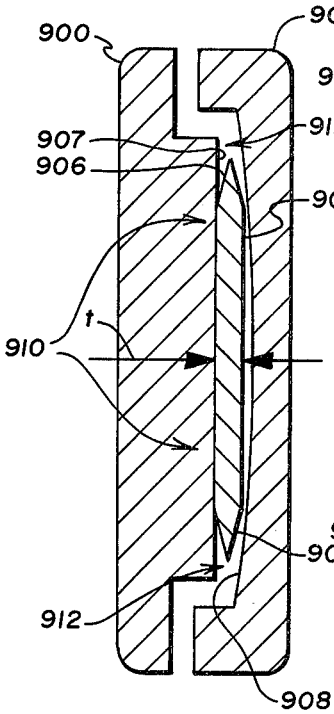
FIG. 11 is a section view of the knife of FIG. 9 taken along line 12—12 of FIG. 10 with the blade on center.
Figure 12:
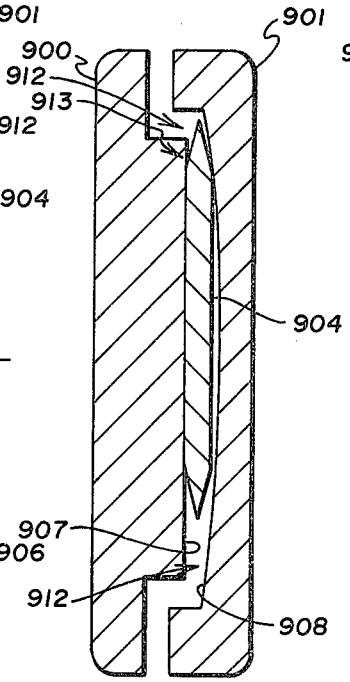
FIG. 12 is a section view of the knife of FIG. 9 taken along line 12—12 of FIG. 10 with the blade locked off-center.
Figure 13:
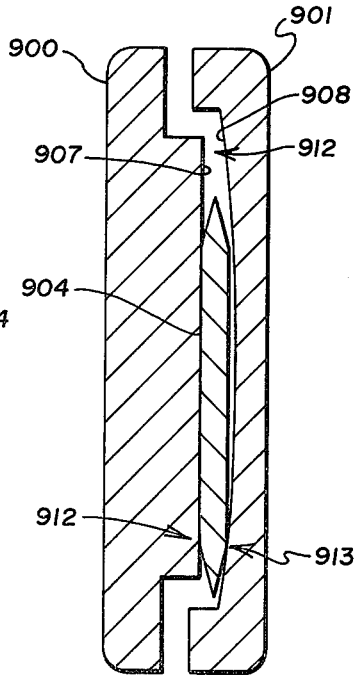
FIG. 13 is a section view of the knife of FIG. 9 taken along line 13—13 of FIG. 10 with the blade locked off center;.

The most preferred embodiment of the invention takes the form shown in FIGS. 9–13. Two elongated interfitting holder parts 900 and 901 may be fastened tightly together by means of a screw 902 or the like and an alignment stud 903. When fastened together, a gap remains therebetween as a guideway for receiving a blade 904 into the holder. The gap is best seen in FIGS. 11–13. Blade 904 has a certain overall height (*h*) and thickness (*t*), indicated in FIGS. 10 and 11, respectively, and at least one cutting edge, preferably two cutting edges, 906 of lesser thickness due to their tapering configurations for the blade body proper.

Holder part 900 includes a raised surface 907 which may generally be of the size and configuration of the blade to be used in the holder. Holder part 901 includes an inner depression 908, best seen in FIGS. 10–13, corresponding generally in overall size and shape to raised portion 906. Depression 908 receives raised portion 906 when the holder parts are fitted together to form therebetween the aforementioned gap. It is the inner surfaces of the raised portion 906 and the depression 908 which form the guideway for blade 904. The relative topography or contour of these adjacent surfaces defines an area or areas in the guideway, generally identical in areas 910, having a width which corresponds generally at least minimally to about the thickness of the blade body and an area or areas, generally indicated at 912, of lesser width sized to receive the cutting edges of the blade but smaller than the thickness of the blade body. Thus, when the blade is cocked as shown in FIG. 10, portions of the blade body proper, generally indicated at 913, are wedged into the narrower areas, in the same manner as the blade is wedged into the grooves of the channel members of the previously described embodiments, to lock the blade in a cutting position as shown in FIG. 10. As with the other embodiments, the narrow areas are preferably sized and spaced to prevent the contact of a cutting edge with any surface which might dull it.

Figure 14:
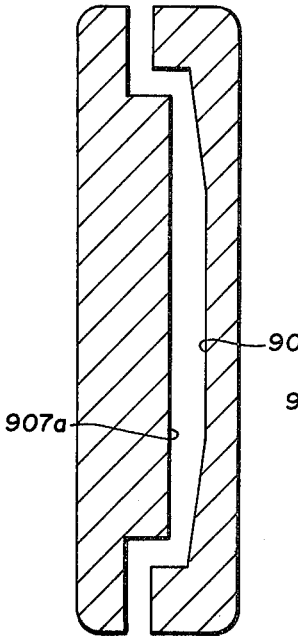
FIGS. 14–16 are schematicly shown alternate forms of the invention.
Figure 15:
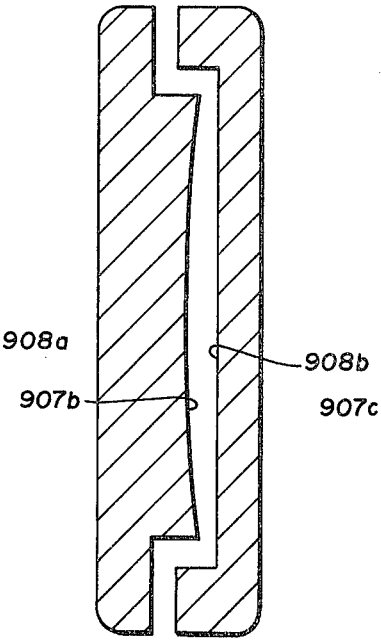
Figure 16:
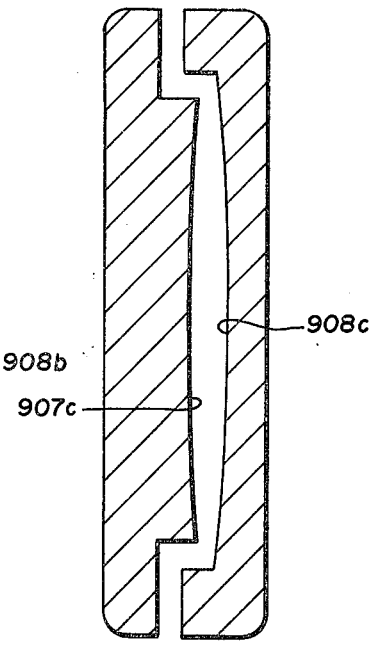

Various configurations may be used on the surfaces to achieve the desired guideway. Some of the more simple configurations are shown. For example, in FIGS. 11–13, raised surface 906 is substantially flat, while the inner surface of depression 908 is curvilinear in cross section to provide a central area of comfortable blade width and upper and lower narrow areas for receiving the cutting edges and in which the blade body may be wedged. This type of configuration is also shown in FIG. 14 in slightly modified form. FIG. 15 schematically shows another arrangement to the same end in which surface area **907*b* is curvilinear and area 908*b* is flat. FIG. 16** shows an arrangement in which both surfaces are curvilinear but reversed relative to each other. Geometrically, other configurations will become apparent for achieving the purposes set forth herein.

As with the embodiment of FIGS. 6–8, the embodiment of FIGS. 9–13, preferably include access apertures 915 for contacting blade 904 when it is withdrawn completely into the holder. In this instance, the apertures are elongated. Slides (not shown) may be fitted into the elongated apertures for contacting the blade and sliding it out of the holder.

As can be seen, the present invention may take various forms and configurations. Generally, it takes the form of a tool which need not be disassembled to change blades. Although primarily described for use in cutting carpeting, it is important to point out that the present invention can also be used for cutting materials such as floor tile or linoleum, vinyl, plastic, rubber, upholstery, ceiling tile, wall board, paneling, roofing materials such as shingles and tarpaper, and many other materials. There is a wide latitude in choice of the exact configurations as well as the choice of materials from which the present invention may be made. The present invention may be adapted for use in conjunction with any standard commercially available cutting tool handles, as well as the ones depicted in the drawings. In addition, although the present invention is shown and described for use in conjunction with a single hand-held cutting tool, it may be also incorporated in more elaborate cutting tools or machines such as the one shown in U.S. Pat. No. 3,859,725.

What is claimed is:

1. Blade holder adapted to use a replaceable blade, comprising:

(a) body receiving means for slidably receiving blade to be used with the holder; and (b) edge receiving means for receiving the top and bottom edges of at least a portion of the blade, the means being sized on the order of the edge width but narrower than the blade width whereby the blade is held by the edge receiving means as a cutting edge of the blade engages an object to be cut due to the wedging of the blade body into the edge receiving means.

2. The holder as in claim 1 wherein said edge receiving means comprises a pair of parallel, spaced-apart channel members, the channel members defining upper and lower grooves for slidably receiving the blade, at least one of said grooves being deeper than the cutting edge of the blade received by the groove and of such a width relative to the body thickness of the blade that the blade is gripped by the sides of the groove when wedged therein.

3. The holder of claim 2 wherein both grooves are of the depth and width defined for accommodating a double-edged blade.

4. The holder in accordance with claim 1 wherein said edge receiving means comprises a pair of parallel, spaced-apart, generally V-shaped members, said V-shaped members each having a groove, said grooves together defining a slot into which the cutting blade may be adjustably slid to any desired position.

5. The holder in accordance with claim 2 wherein the edge receiving means includes a resilient material in each of said grooves, said resilient material protecting the edges of the blade where contacted when in the wedged position so as to prevent damage and loss of sharpness thereto.

6. The holder in accordance with claim 4 wherein said V-shaped members are spaced apart a slightly greater dimension than the blade edges and the grooves are of just sufficient width to allow the blade edges to be easily slid within the grooves to any position selected along the length of said V-shaped members and the cutting edges of the blade do not contact the bottoms of said V-shaped members when the cutting blade is engaged with the object being cut due to the wedging of the blade body in the grooves.

7. The holder in accordance with Claim 1 wherein said edge receiving means is carried by handle means for holding while cutting is performed.

8. The holder in accordance with claim 1 including means rigidly securing said holder to handle means for gripping the tool during the cutting operation.

9. The holder in accordance with claim 4 wherein said V-shaped members are integrally formed from a single member.

10. The holder in accordance with claim 4 wherein said V-shaped members are two separate members, each of which is separately attached to the holder.

11. The holder in accordance with claim 5 wherein said resilient material is a babbit metal.

12. The holder in accordance with claim 5 wherein said resilient material is a tin-lead solder.

13. The holder in accordance with claim 7 wherein said handle means further comprises: means for storing extra cutting blades within said handle means and means for providing easy access to said storing means without disassembling said handle means.

14. The holder in accordance with claim 13 wherein: said storing means comprises a cavity located within said handle means; and said access means comprises a slide mounted for sliding in an outer wall of said handle means, said slide when in closed position providing a closure over the cavity in which the extra blades are stored and when in open position allowing extra blades within the cavity to be removed therefrom.

15. The holder in accordance with claim 1 wherein said edge receiving means is formed of a material having characteristics which protect the cutting edges of a blade from being damaged when the blade is wedged in said means and rigidly held in a cutting position.

16. The holder according to claim 2 including a handle for carrying the channel members interiorly thereof and having an open end through which the blade may be extended or inserted.

17. The holder according to claim 17 wherein an access aperture is included in the handle at the interior end of the channel members for exposing the interior end of the blade to contact by an object inserted into the aperture when the blade is fully inserted into the handle.

18. The holder according to claim 16 including a set screw in the handle and positioned to bear against the blade upon being set.

19. A blade holder for cutting tools and the like using a blade having a body of a certain overall height and thickness and having at least one cutting edge of lesser thickness, the holder including means defining a blade guideway having first and second areas, the first area receiving at least a portion of the blade body proper and having a width substantially the same as the thickness of the blade body proper and a height of at least about the height of the blade body proper whereby the blade may be slidably received in the first area of the guideway, the second area of the guideway having a width less than the thickness of the blade body proper; the overall height of the guideway, including first and second areas together, being greater than the overall height of the blade whereby a blade positioned at least partly in the guideway may be cocked therein so as to wedge part of the blade body proper into the second area of the guideway thus fixedly positioning the blade in the holder for cutting.

20. The blade holder according to claim 19 wherein the first and second areas are adjacent.

21. The blade holder according to claim 19 wherein the blade is double-edged and the holder includes two of the second areas, an upper one above the first area and a lower one below the first area.

22. The blade holder according to claim 20 wherein the upper second area is adjacent an upper portion of the first area and the lower second area is adjacent a lower portion of the first area.

23. The blade holder according to claim 19 including an elongated handle portion.

24. The blade holder according to claim 19 wherein the first and second areas are defined by two interfitting holder parts, one part including a raised area corresponding substantially to the shape and size of the blade to be held, the other part including a depressed area for receiving the raised area when the holder parts are fitted together whereby the surface of the raised area and the surface of the depressed area are positioned adjacent each other, the surfaces being so contoured relative to each other as to define the first and second areas of the blade guideway.

25. The blade holder according to claim 24 wherein the raised area surface is substantially flat and the depressed area surface is curvilinear in cross section with the central portion being spaced further from the raised area surface than the upper and lower portions thereof.

26. The blade holder according to claim 19 including a set screw for holding the blade in position.

27. The blade holder according to claim 19 including an access aperture for contacting the blade inside the holder to move it.

28. The blade holder according to claim 27 wherein the aperture is elongated.

29. The blade holder according to claim 27 wherein the aperture is circular and is positioned at a distance from the front of the holder greater than the length of the blade to be held by the holder.

* * * * *

UNITED STATES PATENT AND TRADEMARK OFFICE

CERTIFICATE OF CORRECTION

PATENT NO. : 4,109,380

DATED : August 29, 1978

INVENTOR(S) : Lloyd E. Anderson

It is certified that error appears in the above-identified patent and that said Letters Patent are hereby corrected as shown below:

Column 7, line 36, "on" should be --or--.

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*